US008931641B2

(12) United States Patent
Schneider

(10) Patent No.: US 8,931,641 B2
(45) Date of Patent: Jan. 13, 2015

(54) DEDUSTING APPARATUS WITH OFFSET DISCHARGE

(75) Inventor: Heinz Schneider, Lancaster, PA (US)

(73) Assignee: Pelletron Corporation, Lancaster, PA (US)

( * ) Notice: Subject to any disclaimer, the term of this patent is extended or adjusted under 35 U.S.C. 154(b) by 703 days.

(21) Appl. No.: 13/041,678

(22) Filed: Mar. 7, 2011

(65) Prior Publication Data

US 2011/0240529 A1 Oct. 6, 2011

Related U.S. Application Data

(60) Provisional application No. 61/319,251, filed on Mar. 30, 2010.

(51) Int. Cl.
*B07B 4/00* (2006.01)
*B07B 4/02* (2006.01)
*B07B 4/08* (2006.01)

(52) U.S. Cl.
CPC .... *B07B 4/02* (2013.01); *B07B 4/08* (2013.01)
USPC ..... 209/137; 209/149

(58) Field of Classification Search
USPC ..... 209/133, 136–141, 145, 149
See application file for complete search history.

(56) References Cited

U.S. PATENT DOCUMENTS

| | | | | |
|---|---|---|---|---|
| 4,631,124 | A * | 12/1986 | Paulson | 209/3 |
| 5,035,331 | A | 7/1991 | Paulson | 209/3 |
| 6,595,369 | B2 | 7/2003 | Paulson | 209/149 |
| 7,380,670 | B2 * | 6/2008 | Paulson et al. | 209/39 |

* cited by examiner

*Primary Examiner* — Joseph C Rodriguez
*Assistant Examiner* — Kalyanavenkateshware Kumar
(74) *Attorney, Agent, or Firm* — Miller Law Group, PLLC

(57) ABSTRACT

A dedusting apparatus has a product outlet offset laterally with respect to a vertical line passing through the product inlet. The dedusting apparatus has a primary wash deck structure with a flow of air passing therethrough into the flow of product. Product discharged off the lower end of the wash deck passes into a Venture zone fed by a flow of air passing through openings in the support leg for the wash deck. The offset dedusting apparatus allows installation of a dedusting apparatus onto a diagonally oriented product discharge conduit without requiring the reconfiguration of the angle of repose for the discharge conduit. The wash deck is formed with reverse slots having deflectors raised upwardly from the top surface of the wash deck to orient the slot to direct the air flow downwardly with the flow of product and to create turbulence in the product flow to facilitate cleaning.

17 Claims, 13 Drawing Sheets

DEDUSTING APPARATUS WITH OFFSET DISCHARGE

CROSS-REFERENCE TO RELATED APPLICATIONS

This application claims domestic priority on U.S. Provisional Patent Application Ser. No. 61/319,251, filed on Mar. 30, 2010, the content of which is incorporated herein by reference.

FIELD OF THE INVENTION

The invention disclosed in this application is directed generally to an apparatus for the cleaning and handling of particulate materials, such as plastic pellets, grains, glass, and the like, and particularly to the a dedusting apparatus that can be utilized with product feed conduits extending at an angle to vertical.

BACKGROUND OF THE INVENTION

It is well known, particularly in the field of transporting and using particulate materials, commonly powders, granules, pellets, and the like, that it is important to keep product particles as free as possible of contaminants. Particulates are usually transported within a facility where they are to be mixed, packaged or used in a pressurized tubular system that in reality produces a stream of material that behaves somewhat like a fluid. As these materials move through the pipes, considerable friction is generated not only among the particles themselves, but also between the tube walls and the particles in the stream. In turn, this friction results in the development of particle dust, broken particles, fluff, streamers (ribbon-like elements that can "grow" into quite long and tangled), glass fibers in glass filled products, that can impede the flow of materials. The characteristics of such a transport system are quite well known, as is the importance and value of keeping product particles as free as possible of contaminants.

The term "contaminant" as used herein includes a broad range of foreign material and includes foreign material as well as broken particles or streamers of the product being transported. The generation of contaminants, also referred to as dust, including microdust, can be from a large number of sources, including, in the way of examples, the creation of dust particles during the processing of plastic pellets in which the larger particles are segregated to be re-ground; organic matter in food grains, such as shells and hulls; the creation of dust in the formation of iron ore pellets; and, as noted previously, the mere conveyance of the pellets in pipes and other mechanical conveying and handling systems. Using plastics as an example, such foreign material could have a detrimental effect on the finished product. Specifically, foreign material different in composition from the primary material, such as dust, and non uniform material of the primary product, such as streamers, would not necessarily have the same melting temperatures as the primary product and would cause flaws when the plastics material is melted and molded. Furthermore, streamers can impact the weighing scale and plug the dosing screws at bagging stations.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and are, therefore, unsellable. It is important to note that since these same non-uniform materials often do not melt at the same temperature as the primary product, the unmelted contaminants cause friction and premature wear to the molding machines, resulting in downtime, lost production, reduced productivity, increased maintenance and thus increased overall production costs.

Since dust and other contaminants are generated mostly by the transport system, it is of primary importance to not only provide apparatus for thoroughly cleaning the particles, but to do so as close to the point of use of the particles as possible so as to avoid the generation of contaminants through additional transport. Accordingly, compact dedusters have been used for many years to clean materials in this application, capable of handling smaller volumes of product, yet also capable of thoroughly cleaning the product. The compact dedusters permit the installation of the deduster immediately before final use of the products, such as being installed directly on top of molding machines or extruders, or on top of silos, as well as under silos, before packaging and bagging, rather than at an earlier stage after which re-contamination can occur before the products are utilized. Of course, the dedusters can be installed as a free standing unit, as well.

Dedusters used to clean contaminants from particulate material can be found in U.S. Pat. No. 5,035,331, granted to Jerome I. Paulson on Jul. 30, 1991, in which air is blown upwardly through wash decks over which a flow of contaminated particulate material is passed so that the flow of air up through the wash decks removes the contaminants from the material flow. A magnetic field is provided by the deduster so that the particulate material flow passes through the magnetic field to neutralize the static charge on the particulates and facilitate the removal of the contaminants from the material. The flow of contaminant laden air is discharged from the deduster, while the cleaned particulate material is passed on to the manufacturing process.

A compact dedusting apparatus is disclosed in U.S. Pat. No. 6,595,369, granted on Jul. 22, 2003, to Jerome I. Paulson. Like the larger dedusting apparatus depicted in U.S. Pat. No. 5,035,331, the follow of particulate material is cleansed of contaminates that have had the static charged attracting the contaminates to the particulates neutralized. The cleaning process utilizes a flow of air passing through the stream of particulate material passing over wash decks. The contaminate-laden air is discharged through the top of the dedusting apparatus, while the cleaned particulate material is discharged from the bottom of the deduster.

These compact dedusters are provided with single and double (back-to-back) wash decks and are utilized with a vertically oriented conduit in which particulate material is conveyed to the manufacturing apparatus utilizing the particulate material. Accordingly, the product inlet opening at the top of the dedusting apparatus is in vertical alignment with the cleaned product outlet opening. The particulate material is introduced into the inlet opening and is metered onto a diagonally oriented primary wash deck through which air is blown from an air supply inlet to clean dust and debris from the particulate material flowing over the wash deck. In these dedusting devices, the particulate material is discharged off the lower end of the wash deck and falls through a Venturi zone in which air is moving upwardly to provide a vigorous cleaning action to the particulate material. The material falling through the Venturi zone is received on a secondary wash deck that is oriented oppositely of the primary wash deck to direct material back to the centrally aligned cleaned product outlet opening.

Not all manufacturing facilities utilizing particulate material that needs to be cleaned from dust and debris before being subjected to a manufacturing process have an appropriately located vertical conduit through which the particulate material is being conveyed. Some manufacturing plants have multiple silos containing storage of particulate material with these silos feeding into a single loading device or a processing machine such as an extruder. Examples of such operations would be a bagging station, big bag loading, truck and railroad car loading facilities, which ultimately lead to a single loading spout from multiple sources. Such silo loading pipes are declined at an angle to horizontal, which in most cases is 60 degrees. The steep angle of 60 degrees is necessary for the good flow of the particulate material through the conduit. Installing a conventional dedusting apparatus having a vertically aligned product inlet and outlet openings to the diagonally oriented discharge conduit would require that the conduit be re-configured to make the conduit more horizontal than originally designed to accommodate the insertion of the vertically oriented dedusting apparatus. Such re-configuration of the product feed conduits can require a significant capital outlay and increase the cost of installation and operation of a dedusting apparatus. Also, in some situations, a conventional compact dedusting apparatus having the inlet and outlet ports vertically aligned are too large vertically to be utilized. Accordingly, a dedusting apparatus having a smaller height dimension would be desirable for use in such height restricted applications.

Accordingly, it would be desirable to provide a dedusting apparatus that can be inserted directly into a diagonally oriented product feed conduit without requiring a re-configuration of the conduit to incorporate a vertically oriented conduit section.

The wash decks in these compact dedusting devices are formed with holes and slots to permit the passage of air through the wash deck to effectively remove contaminates from the flow of particulate material flowing over the surface of the wash deck. Holes or apertures provide a defined stream of air upwardly through the wash deck. The slots are typically formed by slitting and depressing downwardly a portion of the material forming the surface of the wash deck to create a louver that will direct the flow of air upwardly along the surface of the wash deck in opposition to the direction of flow of the particulate material over the wash deck. The oppositely directed air flow from these louvers serves to provide turbulence in the generally laminar flow of particulate material, thus loosening and displacing the contaminates from the particulate material and enhancing the cleaning action of the dedusting apparatus.

It would also be desirable to provide a wash deck configuration that would enhance the cleaning operation of air being blown through a sloped wash deck to remove contaminates from particulate material flowing over the sloped wash deck.

SUMMARY OF THE INVENTION

It is an object of the invention to overcome the disadvantages of the prior art by providing a dedusting apparatus that has a cleaned product outlet opening that is offset laterally from a vertical line passing through the product inlet opening.

It is another object of this invention to provide a dedusting apparatus that can be utilized with diagonally oriented product feed conduits without requiring a reconfiguration of the orientation of the conduit.

It is an advantage of this invention that the dedusting apparatus can be connected to a discharge conduit without requiring the discharge conduit to be reconfigured.

It is a feature of this invention that the cleaned product outlet opening in the dedusting apparatus is positioned vertically below the discharge of particulate material off of the wash deck.

It is another feature of this invention that the dedusting apparatus is constructed with a primary wash deck and a Venturi zone to provide an aggressive cleaning action to the particulate material passing through the dedusting apparatus.

It is still another feature of this invention that the dedusting apparatus can be rotated about an axis corresponding to the product infeed opening to allow the cleaned product outlet opening to be connected to an alternative product discharge conduit.

It is another advantage of this invention that the dedusting apparatus can be installed on a product feed conduit without requiring the angle of the discharge conduit to be changed.

It is still another feature of this invention that the dedusting apparatus is not constructed with a secondary wash deck to direct the flow of cleaned product back to a central cleaned product outlet opening.

It is still another advantage of this invention that the overall height of the dedusting apparatus is smaller than conventional compact dedusting devices.

It is still another object of this invention that wash deck be reconfigured to provide increased turbulence for the particulate material flowing over the surface of the wash deck.

It is yet another feature of this invention that the louvers forming slots in the surface of the wash deck are bent upwardly to form a deflecting structure for the product moving over the surface of the wash deck.

It is a further feature of this invention that the slot formed by the upwardly directed louver is oriented downwardly to blow air through the particulate material after passing over the raised louver structure.

It is a further advantage of this invention that the particulate material flowing over the surface of the wash deck is subjected to an increased turbulence compared to known wash deck configurations.

It is a further object of this invention to provide a dedusting apparatus with an offset cleaned product outlet opening, which is durable in construction, inexpensive of manufacture, carefree of maintenance, facile in assemblage, and simple and effective in use.

These and other objects, features and advantages are accomplished according to the instant invention by providing a dedusting apparatus having a product outlet offset laterally with respect to a vertical line passing through the product inlet. The dedusting apparatus has a primary wash deck structure with a flow of air passing therethrough into the flow of product. Product discharged off the lower end of the wash deck passes into a Venture zone fed by a flow of air passing through openings in the support leg for the wash deck. The offset dedusting apparatus allows installation of a dedusting apparatus onto a diagonally oriented product discharge conduit without requiring the reconfiguration of the angle of repose for the discharge conduit. The wash deck is formed with reverse slots having deflectors raised upwardly from the top surface of the wash deck to orient the slot to direct the air flow downwardly with the flow of product and to create turbulence in the product flow to facilitate cleaning.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
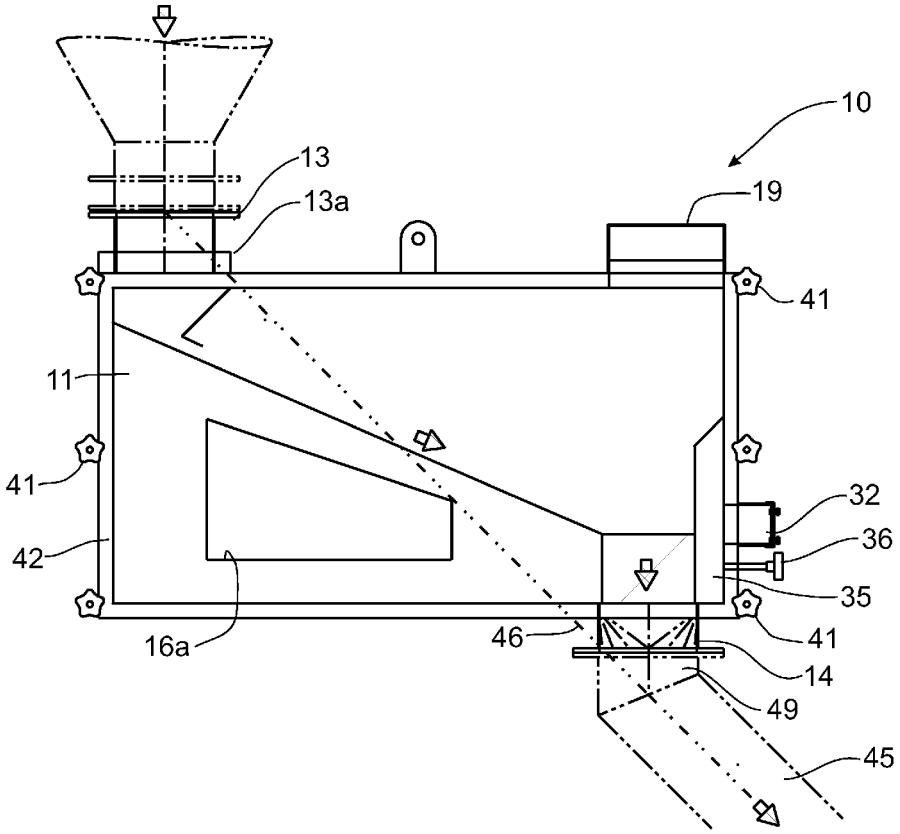
FIG. 1 is a schematic front elevational view of a compact dedusting apparatus incorporating the principles of the instant invention installed into a product feed conduit oriented at a 45 degree diagonal.

The dedusting apparatus is known in the art. A general description of the structure and operation of a conventional dedusting apparatus and a conventional compact dedusting apparatus can be found in U.S. Pat. No. 5,035,331 and in U.S. Pat. No. 6,595,369, both of which were issued to Jerome I. Paulson, the contents of each of these patents being incorporated herein by reference. Typical particulate material to be cleaned by the dedusting apparatus 10 is plastic pellets that are to be passed into an injection molding machine to form plastic components. Examples of plastic particulate material that can be cleaned of contaminate material by the dedusting apparatus 10 are polyester, acrylic, high density polyethylene, polypropylene, nylon, polycarbonates, styrene, and low density polyethylene. Other types of particulate material that can be cleaned in the dedusting apparatus 10 include glass particles and grain.

Referring to FIGS. 1-8, the dedusting apparatus 10, incorporating the principles of the instant invention, defines a cleaned product outlet opening 15 that is offset laterally from a vertical line passing through the product inlet opening. The dedusting apparatus 10 is connected to a vertical portion of a fluent material handling system (not shown) such that the particulate material is fed into a product inlet port 13 located at the top of a generally airtight main housing 11. The main housing 11 has supports a wash deck 20 and an air flow passageway 15 primarily located behind the rear wall 12 of the main housing 11.

The product inlet port 13 is in flow communication with the main housing 11 to direct product particulates onto the wash deck for cleaning. A magnetic coil 13*a* generates a magnetic flux field and is mounted at the inlet port 13 so that the flow of particulate material into the main housing 11 to be cleaned is subjected to the magnetic flux field to neutralize the static charges on the particulate pellets, thus making the separation of the contaminates, particularly microdust, from the pellets easier to accomplish. Air is fed into the housing 11 through a clean air inlet port 16 supported on the air flow passageway 15 behind the housing 11. Air is divided by a baffle 17 cutting across the center of the clean air inlet port 16 so that a portion of the clean air passes through the inlet opening 16*a*, defined by the diagonally extending baffle edge 18, into the housing 11 and the remaining air is distributed through air flow passageway 16 to the Venturi zone 30, as will be described in greater detail below. The edge 18 of the baffle 17 is oriented generally parallel to the slope of the wash deck 20, as will be described in greater detail below, to provide a uniform air flow distribution to the wash deck 20.

The wash deck 20 is supported by the housing 11 to present a downwardly sloping surface from the product inlet port 13 to the product outlet port 14 over which the product to be cleaned, in the form of particulate particles, moves by gravity. An inlet deflector 22 is mounted to the housing 11 in a manner as to be slidable along the top surface of the housing 11 to direct the product particulates onto the wash deck 20. The inlet deflector 22 includes a trailing leg 23 that is oriented generally parallel to the slope of the wash deck 20 to force the product particulates into a laminar flow over the surface of the wash deck 20 toward the outlet port 14. The sliding movement of the inlet deflector 22, as depicted in phantom in FIG. 3, can be effected by manipulation of the adjustment pins 22*a* projecting through the housing 11 to allow adjustment of the depth of the laminar flow by positionally moving the inlet deflector 22 to the desired position.

As seen in FIGS. 3, 7, 9 and 10, the wash deck 20 is formed as a sloped tray having a top surface 24 in which are formed generally horizontal slots 25 and circular openings 27. The horizontal slots 25 are formed in conjunction with an upwardly extending deflector 26 that presents a ramp to the product particulates moving downwardly over the top surface 24 of the wash deck 20. The slot 25 is formed as the horizontal opening across the top surface 24 between the deflector 26 and the top surface 24, such that the air flowing through the slot 25 is directed by the deflector 26 into the product in a generally horizontal direction, which is slightly upwardly with respect to the slope of the top surface 24 of the wash deck 20. Air moving through the circular openings 27 is directed generally perpendicularly to the sloped top surface 24 of the wash deck 20. The net operative result is that the product particulates are subjected to an acceleration and a turbulence generated by the movement of the particulates over the deflectors 26 and by the substantially perpendicular air flow streams emanating from the circular openings 27 and the horizontal slots 25. Accordingly, dust and debris contaminates are released from the product particulates and are carried by the air flow to the dirty air exhaust port 19 at the top of the housing 11.

The product particulates falling off of the lower end 21 of the wash deck 20 drop generally vertically toward the cleaned product outlet port 14 into a Venturi zone 30 through which air is blown upwardly through the falling product particulates to provide a vigorous finally cleaning. Air is directed into the Venturi zone 30 from beneath the wash deck 20 through louvers 29 in the support leg 28, and by the air flow from the clean air inlet port 16 diverted by the baffle 17 into the clean air passageway 15 which extends behind the rear wall 12 of the housing 11 to be directed through a Venturi inlet port 32 at the end of the clean air passageway 15. The size of the Venturi zone 30 and the amount of air flow directed into the Venturi zone 30 from the Venturi inlet port 32 is controlled by a pivoted member 35 operatively connected to a position adjustment lever 36. The movement of the pivoted member 35 is depicted in phantom in FIGS. 3 and 6.

Figure 3:
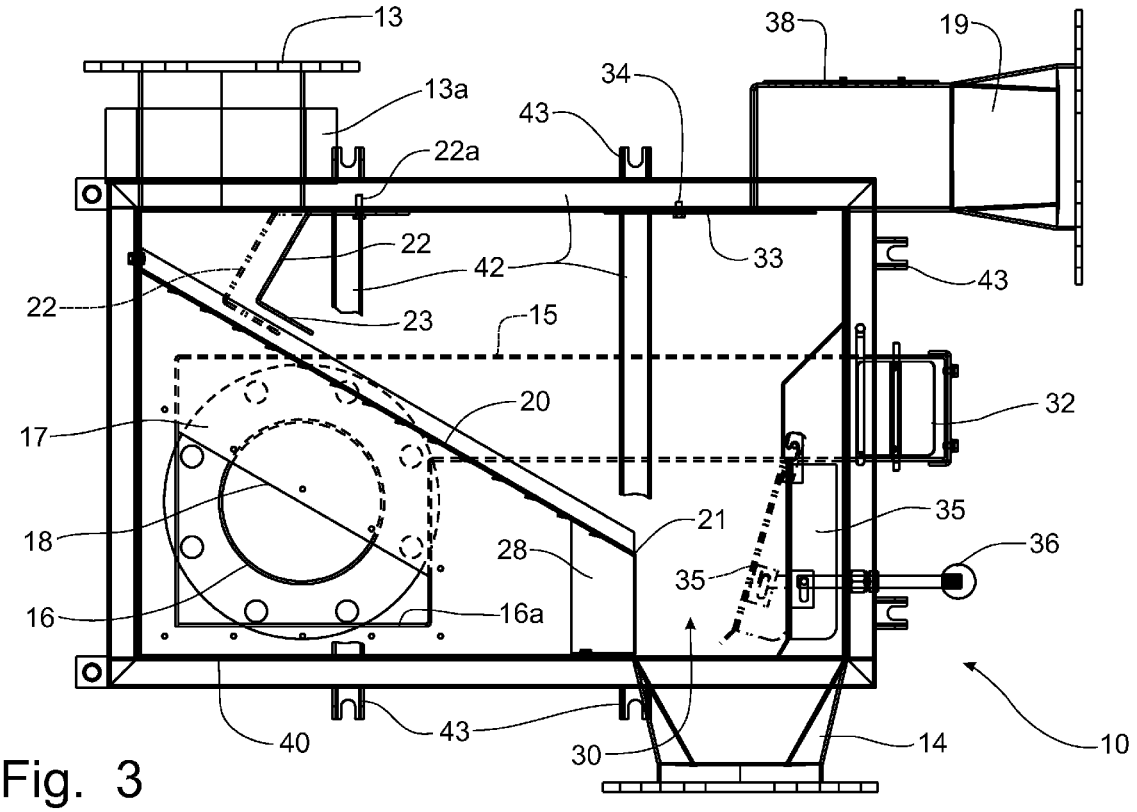
FIG. 3 is a front elevational view of the dedusting apparatus incorporating the principles of the instant invention, the movement of the inlet deflector and the Venturi zone being shown in phantom.
Figure 4:
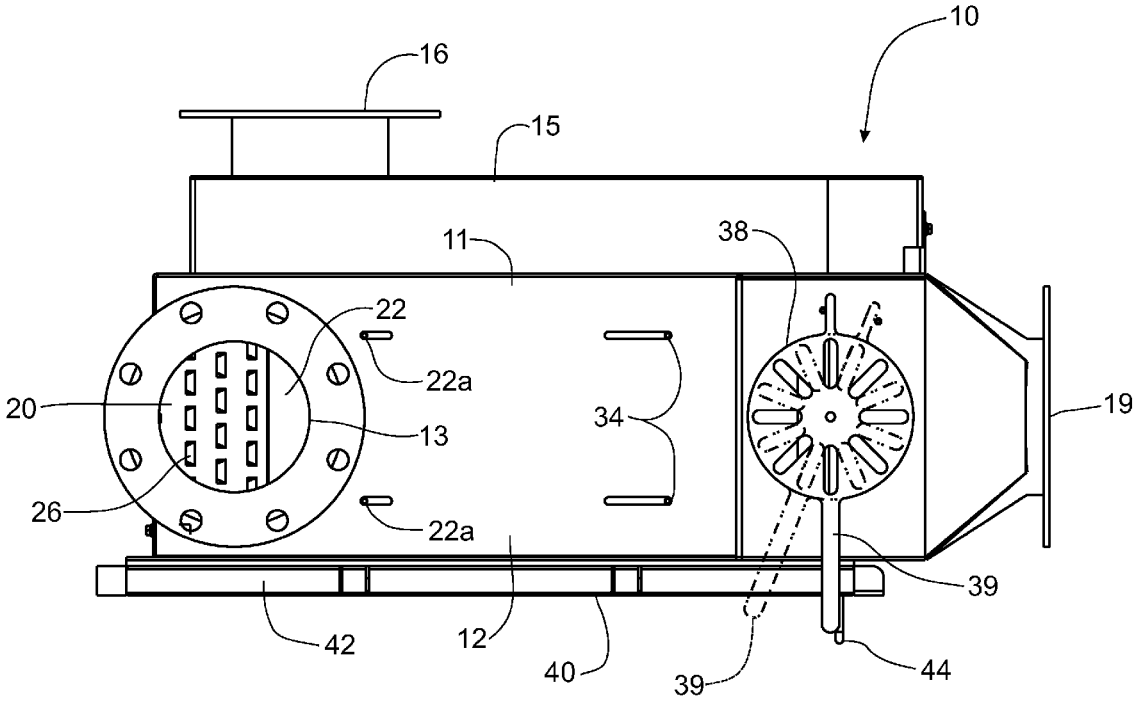
FIG. 4 is a top plan view of the dedusting apparatus shown in FIG. 3.
Figure 5:
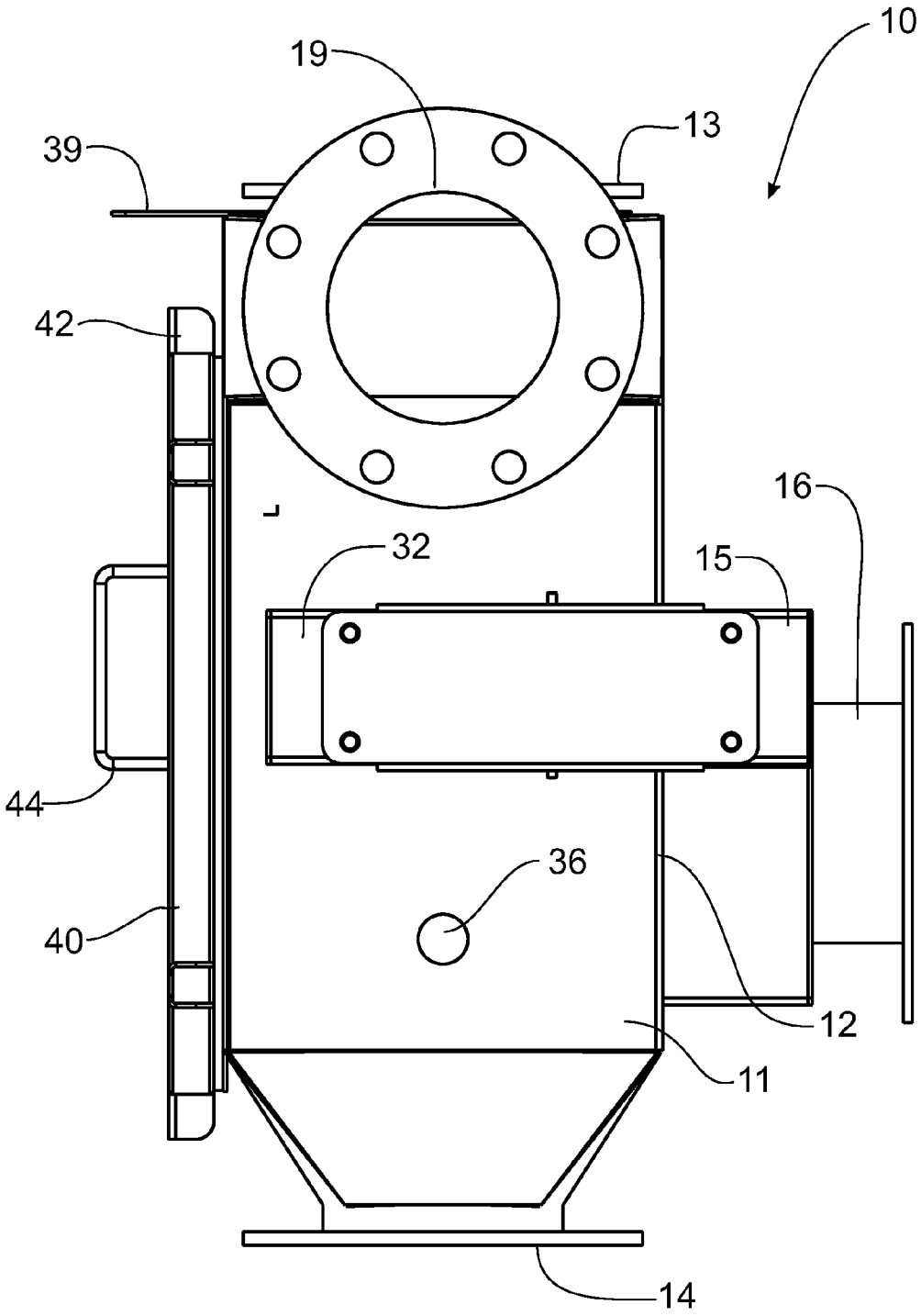
FIG. 5 is an end elevational view of the dedusting apparatus shown in FIG. 3.
Figure 6:
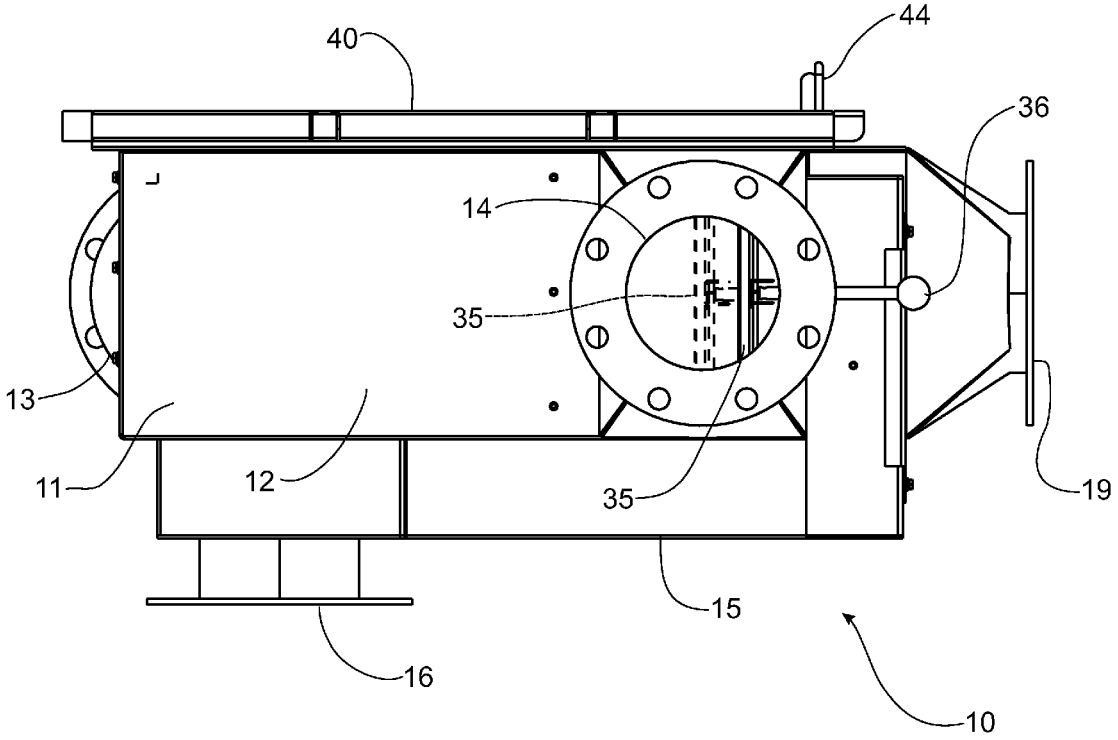
FIG. 6 is a bottom plan view of the dedusting apparatus shown in FIG. 3, the movement of the Venturi zone being shown in phantom.

The flow of air into the Venturi zone 30 from beneath the pivoted member 35 and through the louvers 29 should present a substantial cleaning action to the product particulates falling through the Venturi zone 30, but not so vigorous as to lift the product particulates to the dirty air exhaust port 19. If too much air is moving through the Venturi zone 30, the pivoted member 35 should be retracted to both increase the effective dimensions of the Venturi zone 30 and to decrease the amount of air moving into the Venturi zone. If the front wall 40 of the housing 11 were constructed of a transparent or semi-transparent polycarbonate, as is depicted in FIGS. 3 and 7, the operation of the wash deck assembly could be physically viewed by looking through the front wall 40 to see if product particulates were being carried over into the dirty air exhaust port 19.

The air flow in which the dust and debris contaminates are entrained is discharged from the housing 11 through the dirty air exhaust port 19 located at the top of the housing 11 above the Venturi zone 30 and opposite the product inlet port 13. A slidable plate 33 is mounted on the top surface of the housing 11 to be positionally adjustable through adjustment levers 34 projecting out of the housing 11 to define the throat opening of the dirty air exhaust port 19. An adjustable fresh air vent 38 placed in the conduit forming the dirty air exhaust port 19 can be rotatably adjusted by moving the actuation handle 39, as depicted in phantom in FIG. 4, to allow an inflow of fresh air from the ambient atmosphere. Because of the negative pressure at the dirty air outlet 19, due to the velocity of the air being exhausted, fresh air will flow into the dirty air discharge conduit 19 through the adjustable vent 38. This inflow of fresh air through the vent 38 will reduce the velocity of the air being discharged from the housing 11 and will prevent carryover of cleaned particulates with the discharged air. The adjustment of the vent 38 by rotating the handle 39 will control the amount of fresh air permitted into the dirty air discharge conduit 19.

Figure 7:
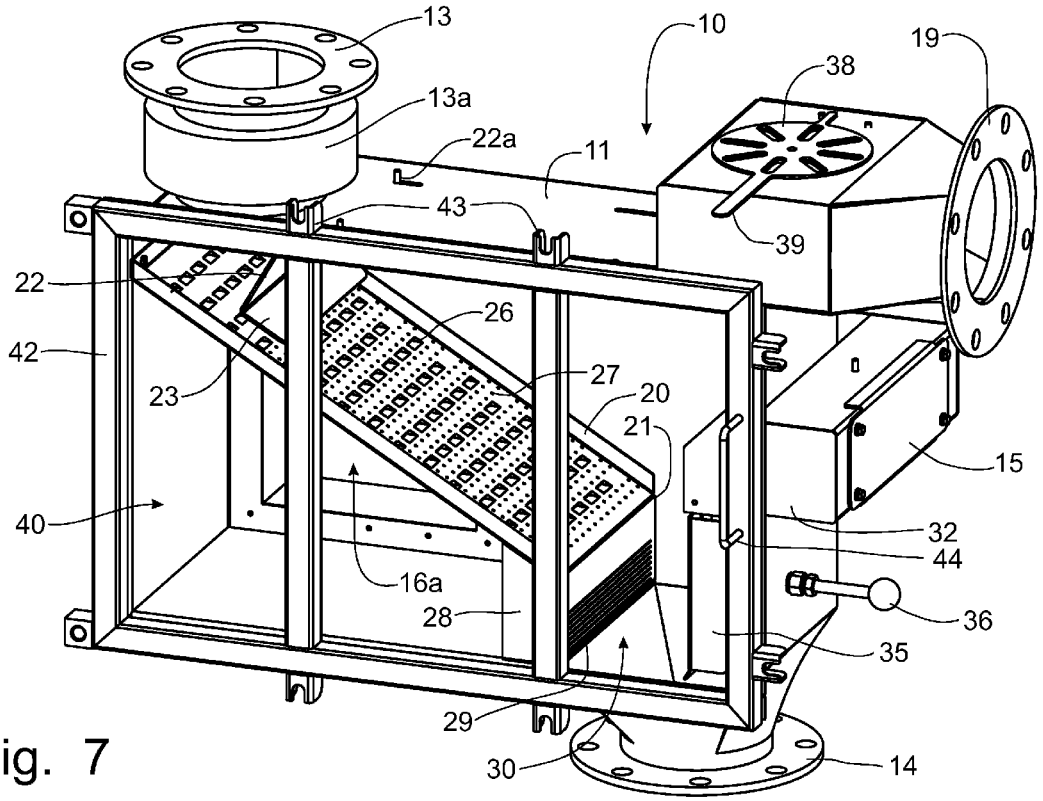
FIG. 7 is a front perspective view of the dedusting apparatus shown in FIG. 3.
Figure 8:
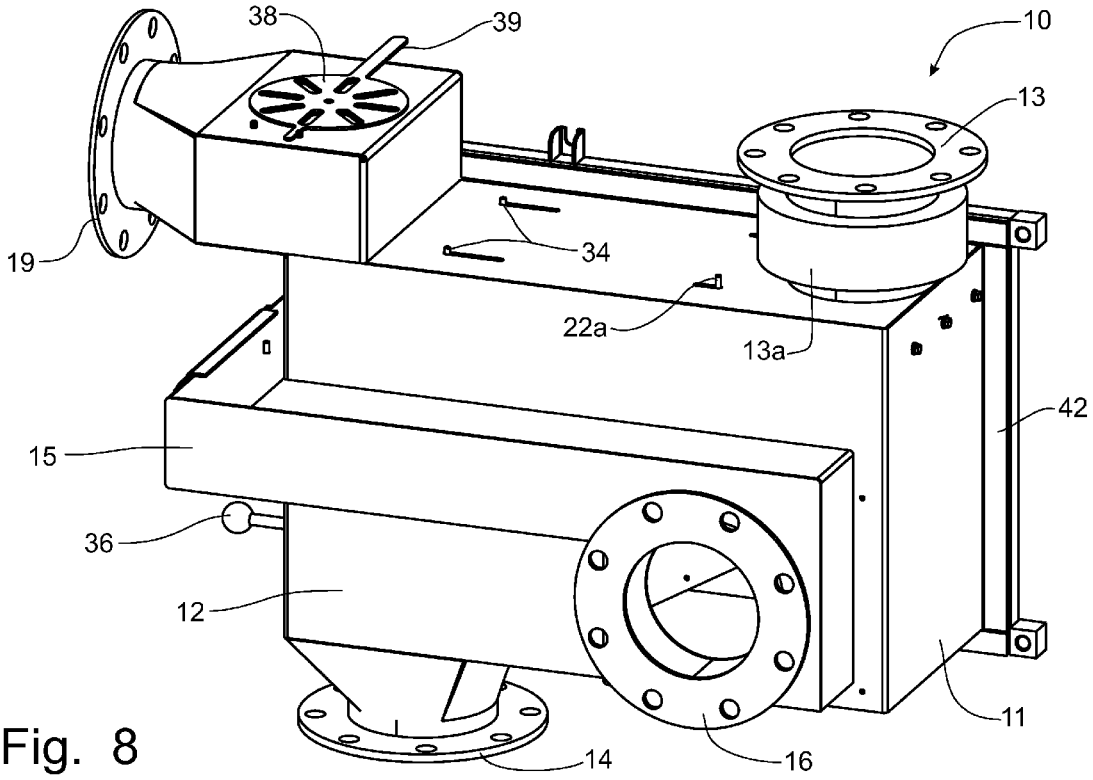
FIG. 8 is a rear perspective view of the dedusting apparatus shown in FIG. 3.
Figure 9:
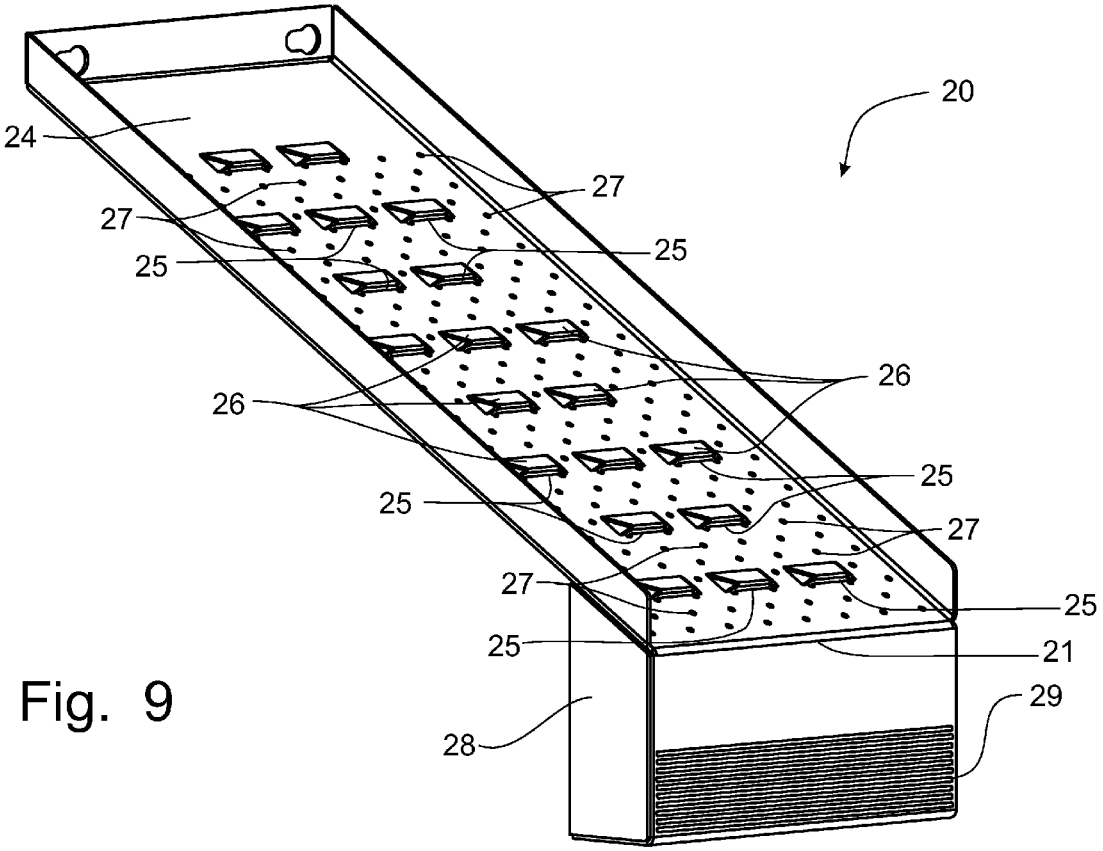
FIG. 9 is a perspective view of the wash deck utilizing reverse louvers on the top surface thereof.
Figure 10:
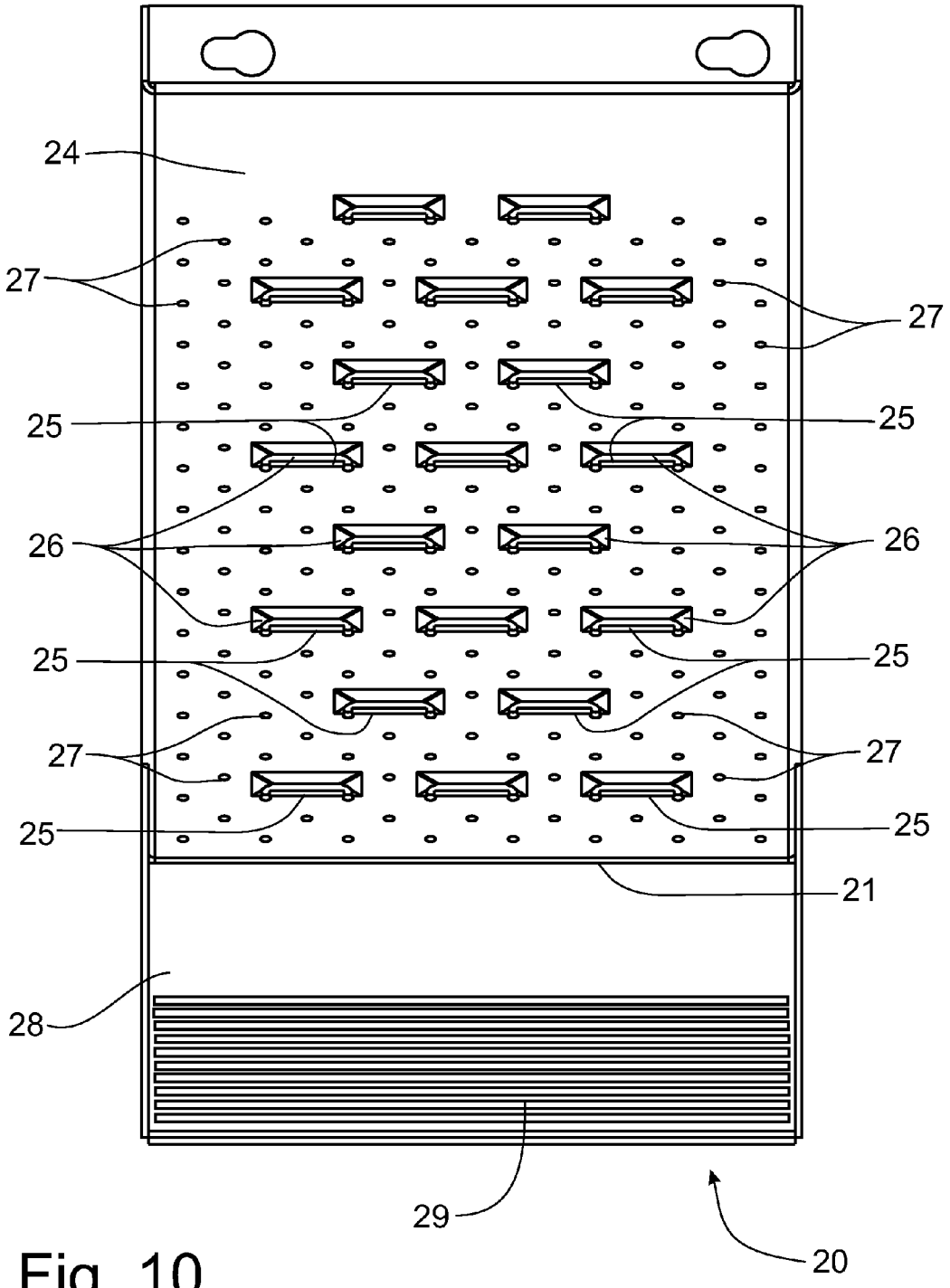
FIG. 10 is a front elevational view of the wash deck shown in FIG. 9.

The transparent front wall 40 of the housing 11 is removable from the housing 11 by releasing fasteners 41 (shown in the schematic view of FIGS. 1 and 2) from the frame supports 43 connecting the frame 42 of the front wall 40 to the housing 11, as is best seen in FIG. 7. Alternatively, the front wall 40 can be formed as a hinged door with a handle 44 to facilitate movement of the front door 40 when released from the frame 42. With the removal of the front wall 40, the interior components, including the wash deck 20, the inlet deflector 22, and the pivoted member 35, can be removed from the housing 11 to facilitate cleaning of the interior of the housing 11 and the removed components 20, 22, 35. As seen in FIGS. 9 and 10, the wash deck 20 is formed with mounting slots 44, as is the inlet deflector 22, to allow the removal of the interior components 20, 22 and 35 without tools simply by shifting the position of the component and allowing the head of the fastener connecting the component to pass through the enlarged slot opening to allow the release, as well as the reinstallation, of the component with respect to the housing 11.

Figure 2:
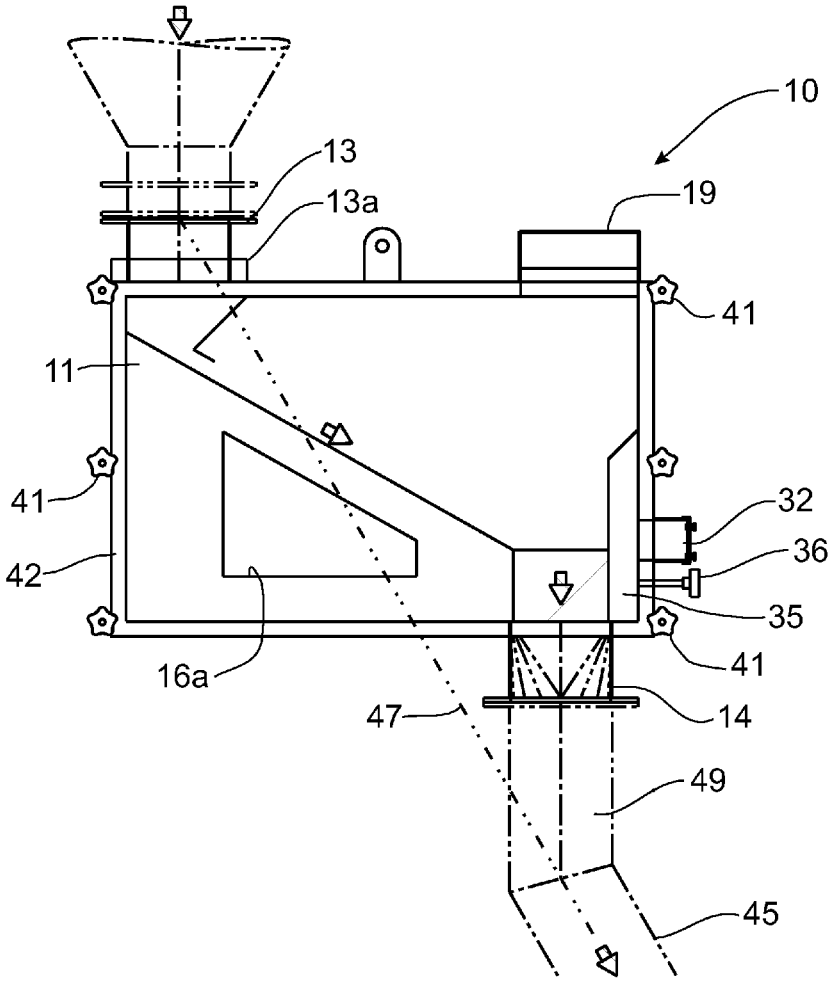
FIG. 2 is a schematic front elevational view of a compact dedusting apparatus incorporating the principles of the instant invention installed into a product feed conduit diagonally oriented at an angle of 60 degrees to horizontal.

The slope of the wash deck 20 is calculated to optimize product flow and air wash of the product particulates passing over the top surface 24 of the wash deck 20. Furthermore, the slope of the wash deck, as well as the dimensions of the housing 11 are calculated to be positionable in engagement with an angled product discharge conduit 45, as is depicted schematically in FIGS. 1 and 2, without requiring the reconfiguration of the slope of the discharge conduit 45. As is shown in FIGS. 1 and 2, the dedusting apparatus 10 is insertable into product conveying system close to the manufacturing equipment so that the lateral distance of the housing 11 from the product inlet port 13 to the product outlet port 14 corresponds to the vertical distance of the angled discharge conduit 45 according to the angle of the discharge conduit 45. In FIG. 1, the angle of the discharge conduit 45 is represented by the dashed line 46 and is represented to be at 45 degrees. Similarly, the angle of the discharge conduit 45 in FIG. 2 is represented by the dashed line 47 to be at 60 degrees. FIGS. 1 and 2 represent two embodiments of the angled discharge pipe 45; however, one of ordinary skill in the art will recognize that many other angular orientations are possible, which can require a slight variance to the configuration of the components in the dedusting apparatus 10. Although an appropriate extension 49 may be added onto the product outlet port 14, the cleaned product particulates being discharged from the outlet port 14 simply fall into the discharge conduit 45 for seamless delivery to the manufacturing facility being fed by the product discharge conduit 45.

In operation, the dedusting apparatus 10 is installed at an appropriate location in conjunction with an angled discharge conduit 45 to receive the product particulates prior to be utilized by the manufacturing facility being fed product particulates flowing through the discharge conduit 45. The product particulates are received through the product inlet port 13 and positioned into a laminar flow over a sloped wash deck 20 by an inlet deflector 22, which is positionally adjustable relative to the wash deck 20 to define a desired product flow thickness over the wash deck 20.

Clean air is received through a clean air inlet port 16 and divided by a baffle 17 between a flow that goes directly into the housing 11 beneath the wash deck 20 and a flow that is directed through a clean air passageway 15 to the Venturi zone 30. The air flowing into the housing 11 beneath the wash deck 20 passes through slots 25 and openings 27 formed in the wash deck 20 and through louvers 29 in the support leg 28 for the wash deck 20. The air passing through the slots 25 and openings 27 in the wash deck 20 create turbulence in the product particulates moving along the top surface 24 of the wash deck 20. Turbulence is enhanced by the upwardly projecting deflectors and the orientation of the horizontal slots 25 which accelerates the flow of the product particulates over the wash deck 20 and further creates turbulence. This movement of air through the wash deck 20 and through the flowing product particulates removes dust and debris contaminates from the product particulates, the static attraction forces having been neutralized by the magnetic flux field induced at the product inlet port 13 by the magnetic flux generator 13*a*.

The cleaned product particulates are discharged off the lower end 21 of the wash deck 20 into a Venturi zone 30 having an upwardly moving air flow coming from the louvers 29 in the wash deck support leg 28 and from the Venturi inlet port 32 at the end of the clean air passageway 15. This upwardly moving air flow provides a vigorous cleaning action to the product particulates falling through the Venturi zone 30 with the air flow therefrom combining with the air flow passing through the wash deck 20 to the dirty air exhaust port 19 at the top of the housing 11. The cleaned product particulates can fall through the product outlet port 14 through an extension 49 into the angled discharge conduit 45 for delivery to the manufacturing facility. The location of the product outlet port 14 at a position laterally displaced from the location of the product inlet port facilitates the utilization of the dedusting apparatus 10 in conjunction with a sloped product discharge conduit 45. The transparent front wall 40 of the housing 11 allows a visual inspection of the operation of the dedusting apparatus 10 to determine if adjustment to the inlet deflector 22 or the Venturi zone 30, through manipulation of the control lever 36 to move the pivoted member 35, is necessary. Furthermore, the removable front wall 40, allows convenient access to the interior of the housing 11 to facilitate cleaning of the housing 11 and all of the removable components therein.

Figure 11:
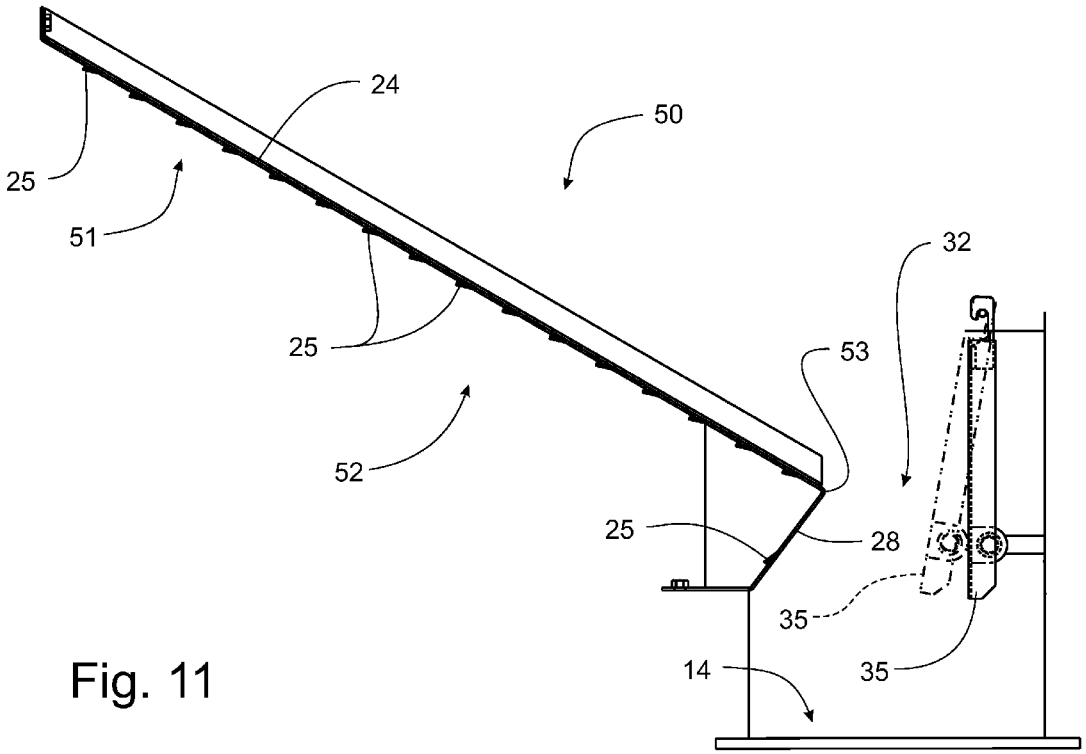
FIG. 11 is a side elevational view of an alternative embodiment of the wash deck and the positionally adjustable member for changing the size of the Venturi zone.
Figure 12:
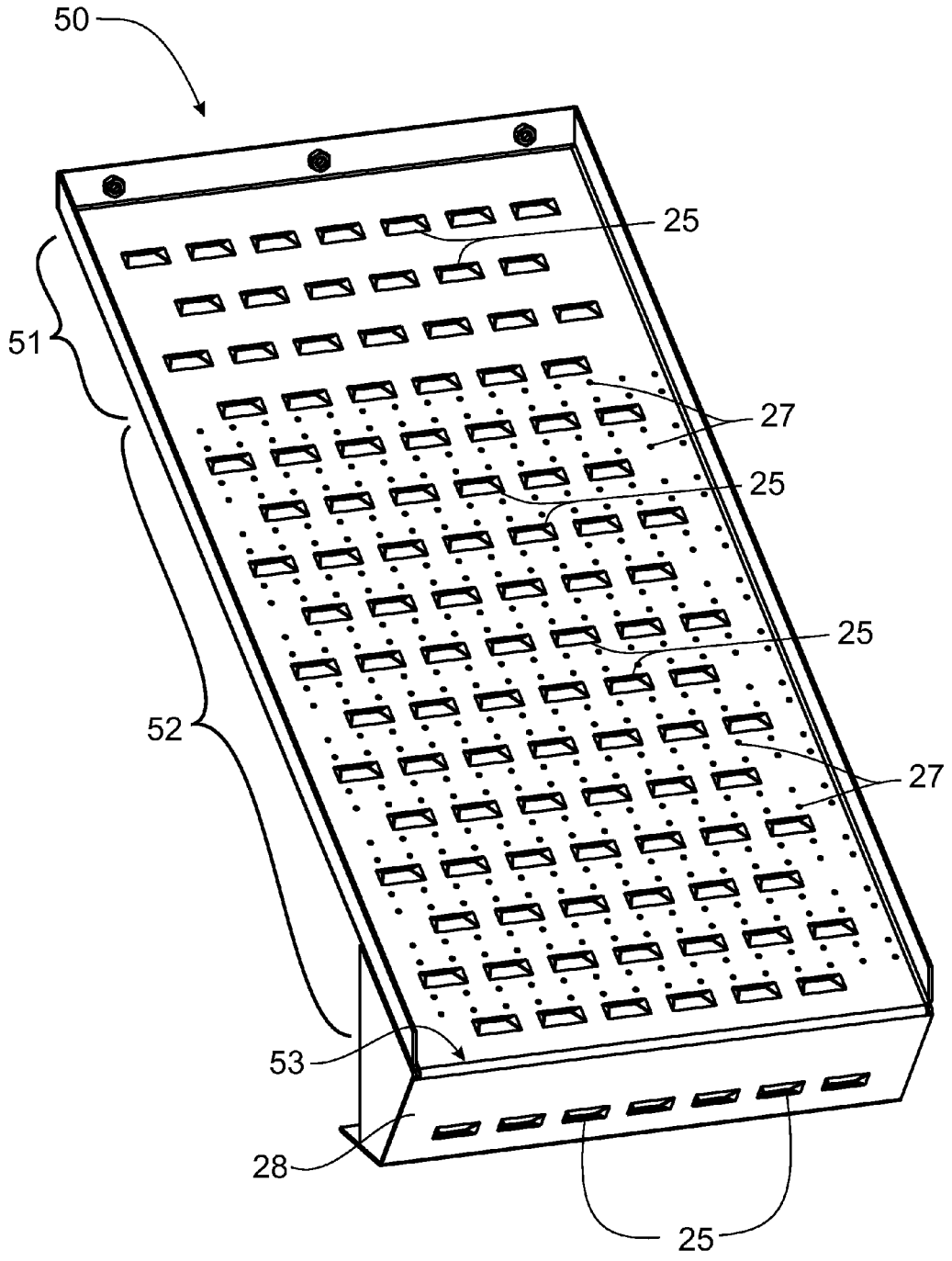
FIG. 12 is a perspective view of the alternative wash deck shown in FIG. 11, utilizing reverse louvers on the top surface thereof.
Figure 13:
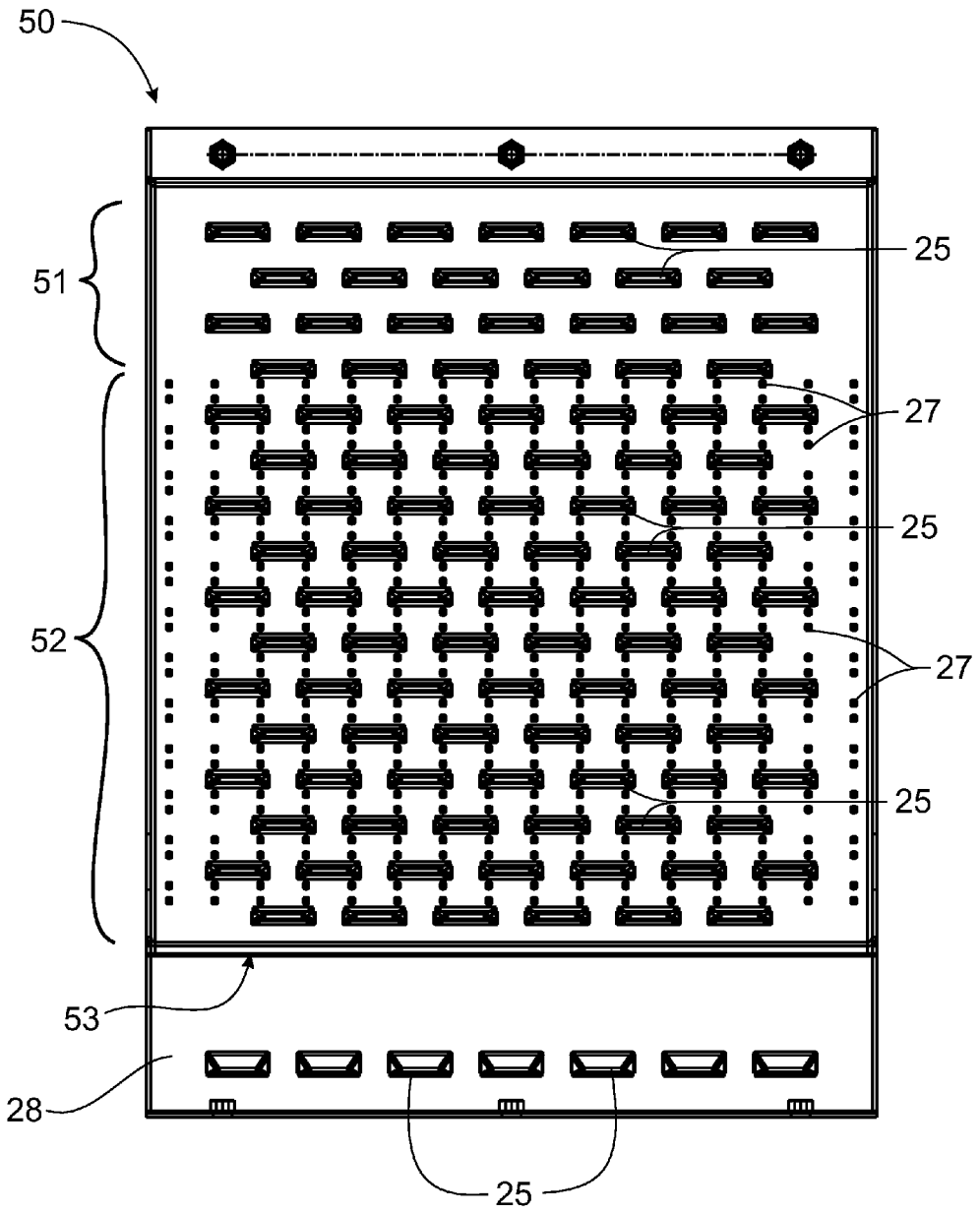
FIG. 13 is a front elevational view of the alternative wash deck shown in FIG. 11.

An alternative configuration of the wash deck 20 is depicted in FIGS. 11-13. This alternative wash deck 50 includes a plurality of slots 25 in the upper area 51 of the wash deck 50 behind the inlet deflector 22 corresponding to the inlet port 13. The slots 25 in the upper area 51 assist in moving the particulate product flowing through the inlet port 13 underneath the deflector 22 along a laminar flow over the top surface 24 of the wash deck. As with the first configuration of the wash deck 20, the major lower portion 52 of the wash deck 50 is formed with a plurality of slots 25 and openings 27 for the passage of air through the wash deck 50 into and through the flow of particular product moving along the top surface 24 of the wash deck 50. As with the wash deck 20, the slots 25 are oriented to direct a flow of air in a direction corresponding to the direction of movement of the particulate material, rather than counter to the material flow as is known in the art. While deflectors 26, as shown with respect to the first wash deck embodiment 20, are preferable to cause turbulence in the material flow, the passage of air from the slots 25 and openings 27 also cause a turbulence in the material flow without the use of the deflectors 26.

The primary difference in the structure of the first and second wash deck embodiments 20, 50 is the configuration at the discharge end 53 at the Venturi zone 32. The alternative wash deck 50 is longer than the first embodiment of the wash deck 20 to provide additional room for deployment of slots 25 and openings 27 and the resulting increased air flow through the flow of particulate material, but also to reduce the size of the Venturi zone 32 with respect to the size of the outlet port 14 to optimize the flow of air through the Venturi zone 32. As a result, the support leg 28 is angled away from the Venturi zone 32, as opposed to be vertical as shown in FIG. 3, to mate with the outlet port 14, as the horizontal dimension of the outlet port 14 is larger than the corresponding horizontal dimension of the Venturi zone 32. As with the structure described above, the Venturi zone 32 is also provided with a pivoted member 35 that can be positionally adjusted to change the size of the Venturi zone for the passage of air therethrough. The support leg 28 is also preferably formed with a plurality of slots 25, and/or louvers 29 as shown in FIG. 10, to direct an appropriate flow of air upwardly through the Venturi zone 32.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

Having thus described the invention, what is claimed is:

1. A dedusting apparatus for removing dust and debris from a flow of particulate material, comprising:

a housing defining a product inlet opening through which said particulate material enters said housing, a product outlet opening through which said particulate material is discharged from said housing, a clean air inlet opening and a dirty air outlet opening, said product outlet opening being laterally offset with respect to said product inlet opening such that said product inlet opening and said product outlet opening are not vertically aligned; and a wash deck mounted in said housing between said product inlet opening and said product outlet opening, said wash deck defining a downwardly sloped upper surface positioned to receive particulate material from said product inlet opening and to discharge particulate material to said product outlet opening, said wash deck being formed with openings therethrough to allow a passage of air through said wash deck into the flow of particulate material over said wash deck, said wash deck including a lower area below said upper area, said lower area terminating in a discharge end located above said product outlet opening to define a Venturi zone between said discharge end of said wash deck and said housing, said wash deck further including a support leg including openings therethrough for the passage of air upwardly into said Venturi zone.

2. The dedusting apparatus of claim 1 wherein said wash deck includes an upper area positioned below said product inlet opening to receive particulate material therefrom, said upper area of said wash deck being formed with a plurality of said openings to direct a flow of air downwardly along said wash deck to assist in the movement of the particulate material along said wash deck.

3. The dedusting apparatus of claim 2 further comprising an inlet deflector positioned above said wash deck at said product inlet opening to create a passageway between said inlet deflector and said wash deck to force said particulate material into a laminar flow along said wash deck, said openings in said upper area of said wash deck directing a flow of air toward said passageway to assist in the movement of particulate material through said passageway.

4. The dedusting apparatus of claim 3 wherein said openings in said upper area are formed as slots extending through said wash deck and being oriented to direct a flow of air therefrom downwardly along the slope of the wash deck toward said passageway.

5. The dedusting apparatus of claim 1 wherein said support leg angles away from said discharge end at said Venturi zone to align with said product outlet opening which has a larger horizontal dimension than a corresponding horizontal dimension of said Venturi zone.

6. The dedusting apparatus of claim 5 wherein said openings in said support leg are formed as elongated slots that direct a flow of air upwardly into said Venturi zone.

7. The dedusting apparatus of claim 1 wherein said openings in said lower area of said wash deck include a plurality of slots formed to direct a flow of air therefrom downwardly along said wash deck in the general direction of the flow of particulate material over the wash deck.

8. The dedusting apparatus of claim 7 wherein each of the slots are formed with a deflector structure projecting upwardly from the upper surface of said wash deck, said deflector structure aiding in directing the flow of air downwardly along the upper surface of the wash deck and causing turbulence in the flow of particulate material along the upper surface of the wash deck toward said discharge end.

9. In a dedusting apparatus for removing dust and debris from a flow of particulate material and having a housing defining a product inlet opening, a product outlet opening through which particulate material is discharged from said housing, a clean air inlet opening and a dirty air outlet opening, said housing supporting a wash deck defining a downwardly sloped upper surface over which particulate material from said product inlet opening moves toward said product outlet opening, said wash deck including openings in said upper surface through which air from said clean air inlet opening passes into the flow of particulate material over said upper surface of said wash deck, the improvement comprising:

a portion of said openings in said wash deck being formed as slots oriented to direct a flow of air downwardly along said upper surface with the direction of flow of particulate material over said upper surface, said product outlet opening being offset laterally with respect to said product inlet opening such that said product inlet opening and said product outlet opening are not vertically aligned, said wash deck includes a lower area below said upper area, said lower area terminating in a discharge end located above said product outlet opening to define a Venturi zone between said discharge end of said wash deck and said housing, said wash deck further including a support leg having openings therethrough for the passage of air upwardly into said Venturi zone.

10. The dedusting apparatus of claim 9 wherein said openings also include circular openings through said wash deck.

11. The dedusting apparatus of claim 9 wherein each slot is formed with a deflector structure projecting upwardly from the upper surface of said wash deck, said deflector structure aiding in directing the flow of air downwardly along the upper surface of the wash deck and causing turbulence in the flow of particulate material along the upper surface of the wash deck.

12. The dedusting apparatus of claim 9 wherein said wash deck includes an upper area positioned below said product inlet opening to receive particulate material therefrom, said upper area of said wash deck being formed with a plurality of said openings to direct a flow of air downwardly along said wash deck to assist in the movement of the particulate material along said wash deck.

13. The dedusting apparatus of claim 9 wherein said support leg angles away from said discharge end at said Venturi zone to align with said product outlet opening which has a larger horizontal dimension than a corresponding horizontal dimension of said Venturi zone.

14. A dedusting apparatus for removing dust and debris from a flow of particulate material, comprising:

a housing defining a product inlet opening through which particulate material enters said housing, a product outlet opening through which particulate material is discharged from said housing, a clean air inlet opening and a dirty air outlet opening, said product outlet opening being laterally offset with respect to said product inlet opening such that said product inlet opening and said product outlet opening are not vertically aligned; and a wash deck defining a downwardly sloped upper surface positioned to receive particulate material from said product inlet opening and to discharge particulate material to said product outlet opening, said wash deck being formed with openings therethrough to allow a passage of air through said wash deck into the flow of particulate material over said wash deck, a portion of said openings through said wash deck being formed as elongated slots that direct a flow of air therefrom downwardly along said wash deck in the general direction of the flow of particulate material over the wash deck said wash deck terminating in a discharge end located above said product outlet opening to define a Venturi zone between said discharge end of said wash deck and said housing, said wash deck further including a support leg including openings therethrough for the passage of air upwardly into said Venturi zone.

15. The dedusting apparatus of claim 14 wherein each of the slots are formed with a deflector structure projecting upwardly from the upper surface of said wash deck, said deflector structure aiding in directing the flow of air downwardly along the upper surface of the wash deck and causing turbulence in the flow of particulate material along the upper surface of the wash deck toward said discharge end.

16. The dedusting apparatus of claim 15 wherein said wash deck includes an upper area positioned below said product inlet opening to receive particulate material therefrom, said upper area of said wash deck being formed with a plurality of said slots extending through said wash deck to direct a flow of air downwardly along said wash deck to assist in the movement of the particulate material along said wash deck.

17. The dedusting apparatus of claim 14 wherein said support leg angles away from said discharge end at said Venturi zone to align with said product outlet opening which has a larger horizontal dimension than a corresponding horizontal dimension of said Venturi zone.

* * * * *